United States Patent [19]

Fielden

[11] Patent Number: 4,563,008

[45] Date of Patent: Jan. 7, 1986

[54] DEVICE FOR PLAYING A PLURALITY OF GAMES

[76] Inventor: Byron G. Fielden, 6 W. 7th Ave., Baltimore, Md. 21225

[21] Appl. No.: 631,341

[22] Filed: Jul. 16, 1984

Related U.S. Application Data

[63] Continuation-in-part of Ser. No. 395,721, Jul. 6, 1982, abandoned.

[51] Int. Cl.[4] ..... A63F 3/00

[52] U.S. Cl. ..... 273/126 R; 273/128 R

[58] Field of Search ..... 273/126 R, 127 B, 260, 273/37

[56] References Cited

U.S. PATENT DOCUMENTS

| | | | |
|---|---|---|---|
| 1,020,315 | 3/1912 | Schutz | 273/126 R |
| 1,349,587 | 8/1920 | Smith et al. | 273/126 R |
| 1,922,578 | 8/1933 | Fernandez | 273/126 R |
| 1,926,920 | 9/1933 | Smith | 273/127 R |
| 1,962,576 | 6/1934 | Yörgen et al. | 273/126 R |
| 2,451,770 | 10/1948 | Parke | 273/127 B |
| 2,693,960 | 11/1954 | Bour | 273/127 B |
| 3,425,696 | 2/1969 | Docum | 273/126 R |
| 3,533,626 | 10/1970 | Smith | 273/127 R |
| 3,572,717 | 3/1971 | Anguella | 273/126 R |
| 4,032,150 | 6/1977 | Wilson | 273/127 B |

*Primary Examiner*—Richard C. Pinkham
*Assistant Examiner*—T. Brown
*Attorney, Agent, or Firm*—Walter G. Finch

[57] ABSTRACT

The invention is an improved device for playing games, particularly as a plurality of games can be played upon the device. The device has a basic structure to which are added a plurality of different fixtures in different arrangements for at least four different games. The device consists of a platform-like structure having partially enclosing sides and an end. An end portion of the structure is arranged for catching playing pieces for some of the games and for storage of the playing pieces at other times. Markings on the surface of the platform-like structure provided for scoring and for arranging playing pieces. Optional supports are provided where elevation of the platform-like structure is required.

10 Claims, 12 Drawing Figures

DEVICE FOR PLAYING A PLURALITY OF GAMES

This patent application is a continuation-in-part of my U.S. patient application Ser. No. 395,721 filed July 6, 1982 (abandoned) for "Device for Playing a Plurality of Games".

BACKGROUND AND SUMMARY OF THE INVENTION

The invention relates to games, and in particular to a plurality of games played on a single device. Specifically, the invention relates to a structure on which a plurality of games may be played, including playing pieces adapted for each of the plurality of games.

Many games are played on platform-like surfaces, but usually each game has its own particular platform-like structure In the present invention a single platform-like structure is used for a plurality of games by the use of sub-structures which can be added or removed from the single platformlike structure. Playing pieces, of various configurations, are provided for each of the games.

In the present invention four specific games are provided, including the necessary sub-structures or components to change from one game to another, and the necessary playing pieces for each of the games. In describing the device, the sub-structures or components to be added for each game will be described in detail, as well as the associated playing pieces and the procedure for playing the game and the scoring system.

It is to be understood that variations in the procedure of play or the method of scoring, some of which will be noted, are within the scope and intent of this invention.

The game device may be fabricated in a plurality of sizes for use by all ages of users. The game device is usable in the home, recreation centers, places of amusement, and other similar places where people live or congregate.

A need has existed for a long time for a game device that is easily restructured in a plurality of layouts to facilitate playing a variety of games that may be desired by the users at the time. This invention provides such a device.

It is, therefore, an object of this invention to provide a device on which a plurality of games may be played.

It is another object of this invention to provide a device having associated components which can be assembled to provide separate arrangements for different games.

It is also an object of this invention to provide a device having associated playing pieces to play a variety of games.

It is still another object of this invention to provide a device that may be fabricated in a range of sizes for different age groups and for different use locations.

Further objects and advantages of the invention will become more apparent in light of the following description of the preferred embodiments.

DESCRIPTION OF THE PREFERRED EMBODIMENTS

Figure 1:
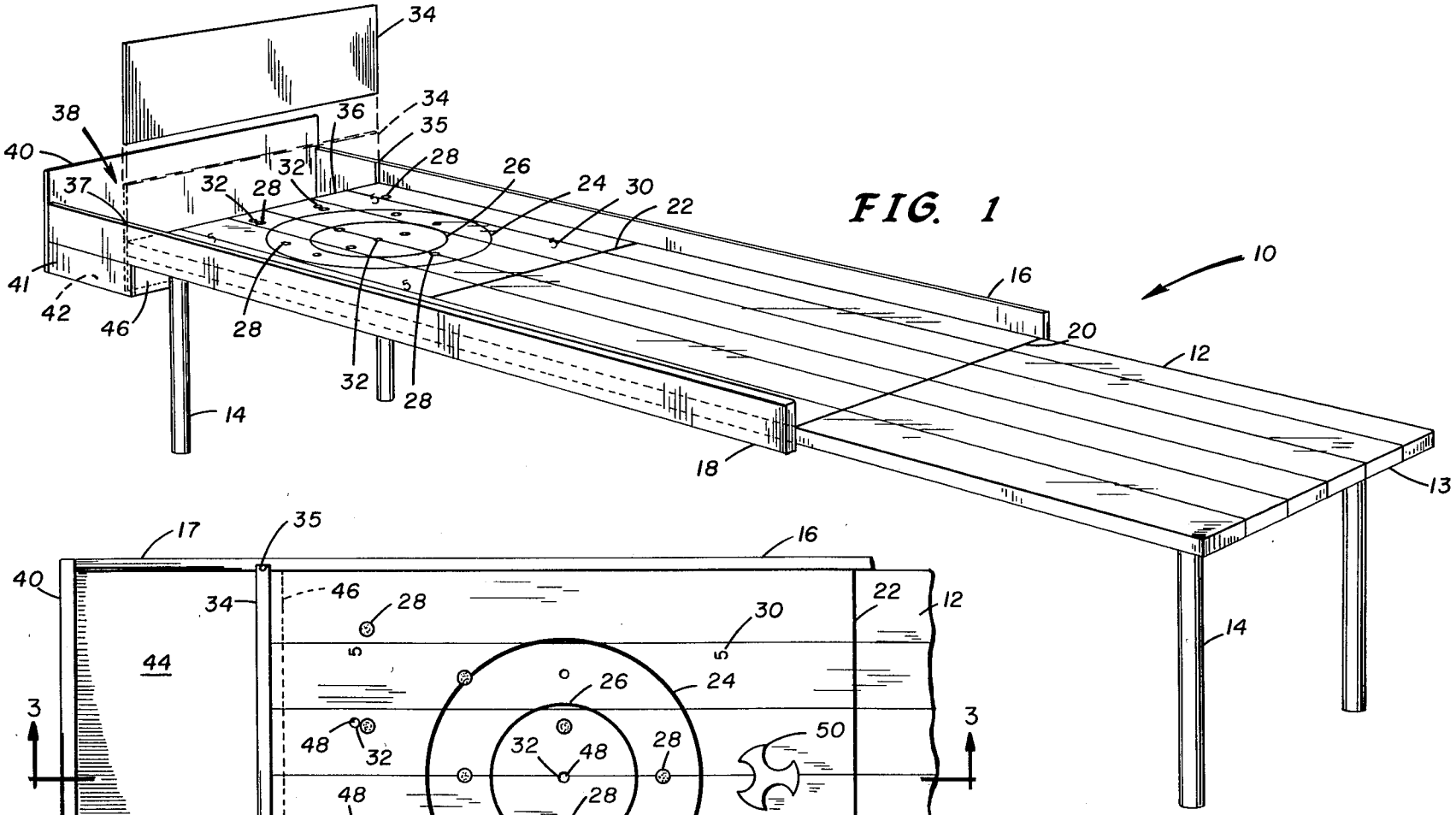
FIG. 1 is a pictorial perspective of a game device for playing a plurality of games.

Referring now to the drawings, and particularly to FIG. 1, a device for playing a plurality of games is shown at 10. The games or game types associated with the device for playing a plurality of games 10 are a part of the device, as the components of the structure used to set up each game and the playing pieces are specific parts of the overall structure. Likewise, variations to the games cited herein are also a part of the invention which give the device for playing a plurality of games 10 its universal facility.

Turning now to the basic structure of the device for playing a plurality of games, the basic structure consists of: a playing surface 12; two sides or side boards or bouncing boards 16 and 18; a catcher box or pit means 38; and optional legs or supports 14. Further details of the aforementioned components of the basic structure are described hereinafter.

The playing surface 12 may be provided in a plurality of sizes depending upon space available for use and the age group using the device playing a plurality of games 10. Sizes may vary from toy-like sizes for small children to full-size units for adults, all taking the same configuration and arrangement. The associated components are appropriately proportioned.

The playing surface 12 has a playing end 13 and a catcher box or pit end 36. The markings on the playing surface 12 will be described hereinafter when describing the plurality of games which can be played upon the device for playing a plurality of games 10, hereinafter referred to as the device 10.

The sides 16 and 18, one on each side of the playing surface 12, may also be called side boards 16 and 18 or bouncing boards 16 and 18 to associate them with a use in the skills used in playing certain games. The sides 16 and 18 at the player end of the playing surface 12 are spaced from the playing end 13 and extend beyond the catcher box or pit end 36 to form the upper portion sides 17 and 19 of the catcher box or pit 38. Thus, the sides 16 and 18 extend along only a portion of the playing surface 12 in order to give clearance above the playing surface 12 for the moving hands and arms of the player. The upper portion sides 17 and 19 of the catcher box or pit 38 are extensions of the sides 16 and 18 respectively and are integrally and monolithically a part thereof.

The catcher box or pit 38 consists of: a back board or end 40; the aforementioned upper portion sides 17 and 19; lower portion sides 41; lower front member 46; a bottom 42; and a covering means 44. It is to be noted that the back board or end 40 extends above the top edges or surfaces of the upper portion sides 17 and 19 and extends downwardly a distance to meet the rearward ends of the upper portion sides 17 and 19 and the lower portion sides 41. Thus, the aforementioned elements when assembled form the catcher box or pit 38, the cover means 44 covers the bottom 42 to cushion falling game components and/or playing pieces that drop into the catcher box or pit 38, as hereinafter described.

It is to be noted that the aforementioned components and elements thereof may be wood, metal, plastics or any other suitable material or combinations thereof, and suitably fastened and affixed to each other to form the configuration described and illustrated. Likewise, the game components and playing pieces, described hereinafter, may be of similar materials or combinations thereof. The covering means may be of heavy felt or any other material that is rug-like and that can serve the purpose as a cushion effect.

The basic structure described hereinbefore may be placed upon a table-like means, if available, or may be affixed to a wall (not shown), or may be supported by suitable legs 14 of suitable materials as described hereinafter. The legs 14 may be round, square, or any other geometrical configuration. The legs 14 may be affixed to the underside of the playing surface 12 by suitable means, such as an attached flange means 52.

Although braces for the legs 14 have not been shown, it is to be understood that suitable leg braces to provide more rigidity are within the scope and intent of the invention.

The height that the playing surface 12 is spaced from the floor may be set in accordance with the age group playing the games (comparable to the basic structure fabricated). It is also to be understood that it is within the scope and intent of the invention to provide adjustable height legs 14 to fit various age groups. As shown, the legs 14 are adjustable telescoping type legs.

Turning now to the game components and playing pieces that are a part of the device 10, it is to be noted that the game components consist of markings which are made permanently upon the playing surface 12, and removably affixed members which are removably affixed to the basic structure when a specific game is played. These latter removably affixed components will be described as the various games are described.

The permanent markings on the playing surface 12 are utilized in different games as described hereinafter. There are two transverse lines, perpendicular to the sides 16 and 18, on the playing surface 12, one is a first foul line 20, and the other is a second foul line 22. The second foul line 22 may also be referred to as the scoring line 22 to differentiate it from the first foul line 20.

In all games the first foul line 20 is the limit of approach that a member of the body of a player may reach. If that line is passed during initiation of motion to a playing piece, the thrust of the playing piece is a foul and not counted, or as an alternative a penalty score may be given to the opponent, or both.

All playing pieces put in motion by a player must at least reach and cross the second foul or scoring line 22 to be able to score points. Playing pieces that do not reach the second foul line are treated the same as the aforementioned procedures for the first foul line. As ground rules may be developed for each game by the players, one such ground rule might be the removal of such a playing piece that does not reach the second foul or scoring line 22. Likewise, suitable ground rules may be established for playing pieces that stop on and lie across the second foul or scoring line.

Two circles are made about the center of the rectangular area of the playing between the second foul or scoring line 22 and the catcher box or pit end 36 of the playing surface 12. The center of these circles, first or inner circle 26 and second or outer circle 24, is therefore centrally located between the sides 16 and 18 and between the aforementioned second foul or scoring line 22 and the catcher box or pit end 36 of the playing surface 12. As later described, a hole 32 for a peg 48 is centered on this same common center of the first and second circles 26 and 24, respectively. These circles 26 and 24 are permanently marked upon the playing surface 12.

Figure 2:
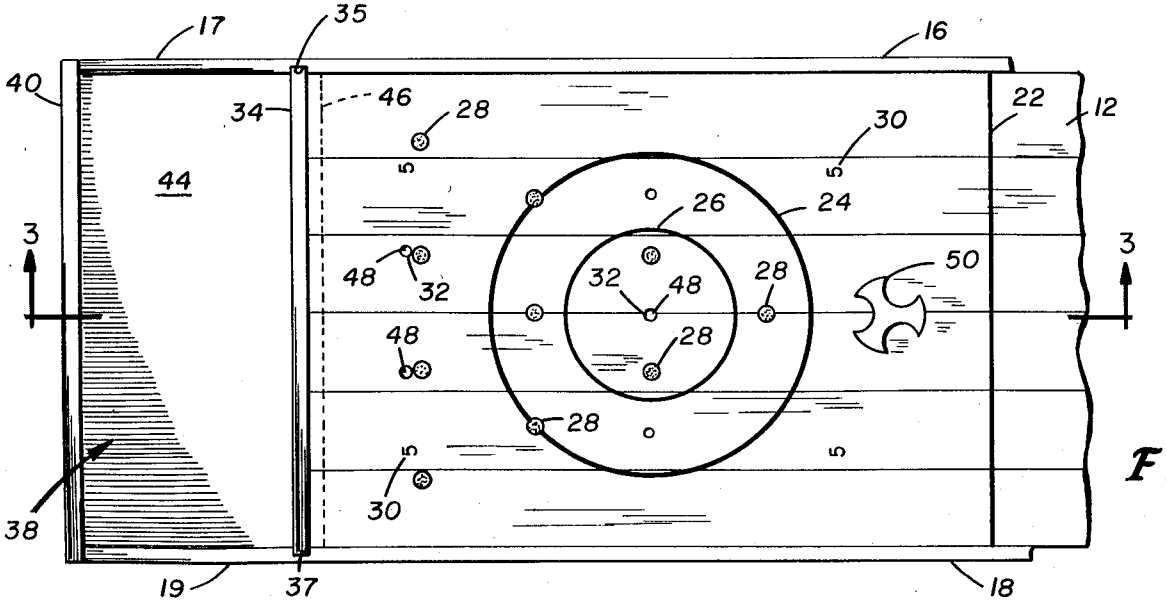
FIG. 2 is a partial plan view of FIG. 1 showing components and playing piece added for a first game.

The numeral "5" is permanently marked upon the playing surface 12 in four locations 30. Two of the numeral "5" at location 30 are each spaced equally from side 16 and two from side 18 as shown in FIG. 2. Likewise, two of the respective numerals "5" at the four locations 30 are spaced similarly from the second foul or scoring line 22 and two from the catcher box or pit end 36 of the playing surface 12.

The numerals "5" at the four locations 30 are used to designate a score of five in games which utilize position of a playing piece to determine a score. Thus, the score of five is for any of the area of the playing surface outside the second or outer circle 24 and between the second foul or scoring line 22 and the edge of the playing surface at the catcher box or pit end 36. Playing pieces within the first or inner circle 24 may be given a higher score, such as fifteen; and playing pieces outside of the first or inner circle 24, but within the outer circle 26 may be given a score between the five and the fifteen, such as ten. Ground rules may be made for scoring playing pieces which lie across the line, a common method being that if any portion of a playing piece covers any portion of a line it is counted as being across that line.

Also, permanently marked on the playing surface 12 are 10 small circles or spots 28 in a triangular configuration. The spots 28 in a triangular configuration are situated and located in four rows as follows: one spot 28 in the first row nearest the second foul or scoring line 22; two spots 28 in the second row; three spots 28 in the third row; and four spots 28 in the last row. All four rows are each on parallel lines with each other and transversely across the playing surface 12, such parallel lines being further parallel with said second foul or scoring line 22.

The four rows of spots 28 are equally spaced apart from the first row back to fourth row. The first row of one spot 28 is spaced from the second foul or scoring line 22. For positioning, the second row of two spots 28 is centered transversely across the common center of the two concentric circles 26 and 24 and equally spaced from the common center. Longitudinally along the playing surface 12, the triangular configuration of ten spots 28 is longitudinally centered through the aforementioned common center of the two concentric circles 26 and 24.

In formation of the triangular configuration the center spot 28 of the three spots 28 in the third row is directly in line with and spaced from the one spot 28 in the first row. The two interiorly placed spots 28 of the four spots 28 in the fourth row are also each directly in line with and spaced from the two spots 28 in the second row. Three straight lines may be phantomly drawn through exteriorly placed spots 28 in each row to form a triangle with its apex as the spot 28 in the first row. The triangular configuration of the ten spots 28 is substantially like the layout of ten pins in bowling games and can be observed best in FIG. 2 where the ten spots 28 have been shaded. The ten spots 28 are permanently marked on the playing surface 12.

Turning now to the game components that are part of the device 10, there are three specific components: a removably inserted and affixed back board or back-stop 34; a plurality of peg-like members 48; and a plurality of tapered pin members 60.

The back-stop 34 can be seen in FIGS. 1, 2, 3, and 6. One of the plurality of peg-like members 48 can be seen in cross section in FIGS. 3 and 7 and also in side view in FIG. 3 and in perspective in FIG. 4. The peg-like members 48 are somewhat like short dowels. One of the plurality of tapered pin members 60 is shown in perspective in FIG. 10, and ten are shown in plan view in FIG. 9, each being located the same as and on the aforementioned ten spots 28.

Figure 3:
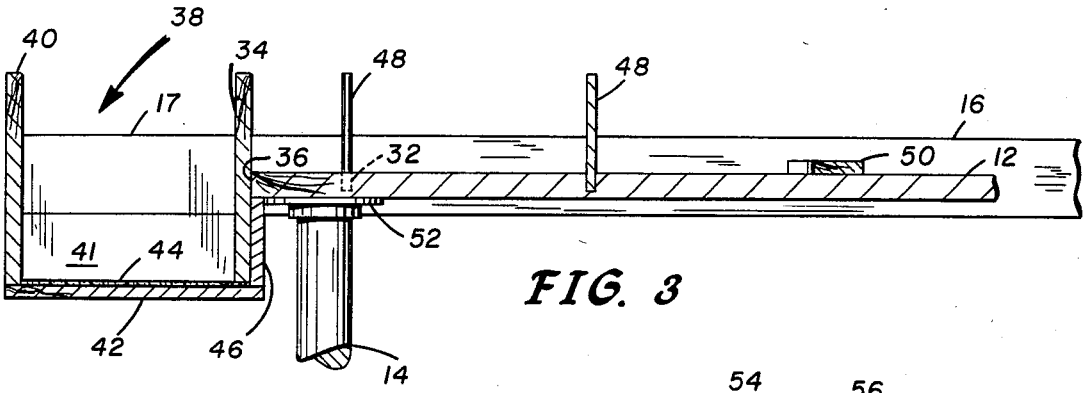
FIG. 3 is a partial cross-sectional view along line 3—3 of FIG. 2.
Figure 4:
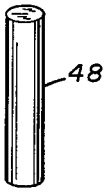
FIG. 4 is a perspective view of a first component used for a first, second, or fourth game.
Figure 6:
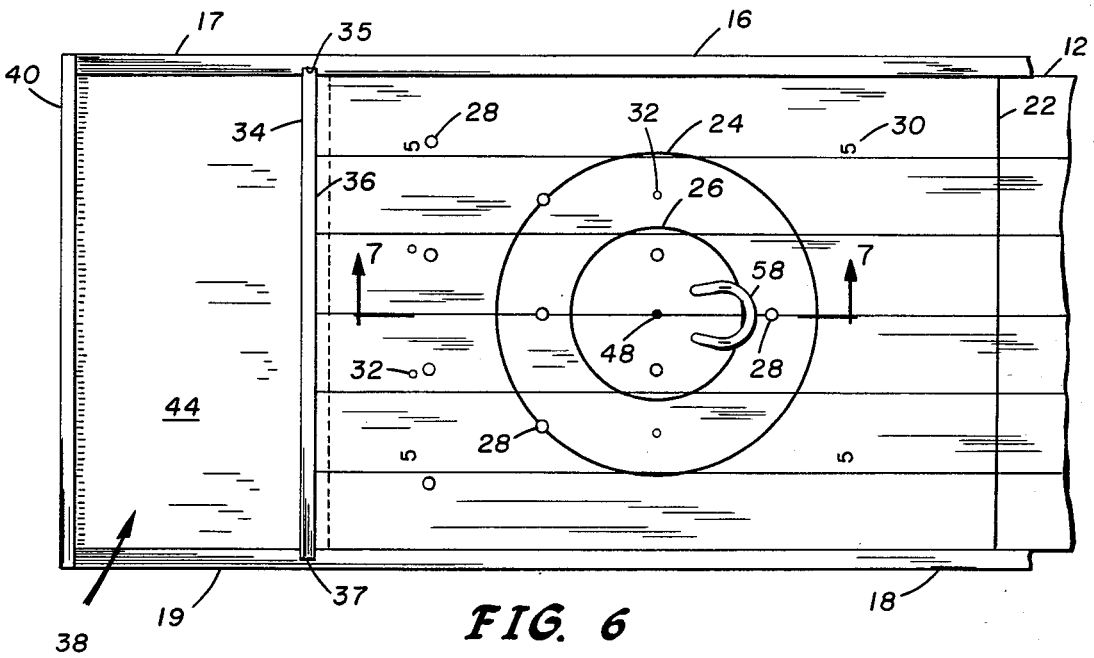
FIG. 6 is a partial plan view of FIG. 1 showing components and playing piece added for a second game.
Figure 7:
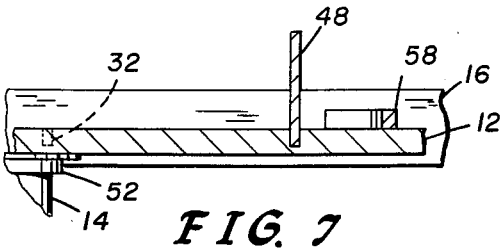
FIG. 7 is a partial cross section on line 7—7 of FIG. 6.

The removably affixed back-stop 34 is removably inserted in slots 35 and 37 which are cut or formed in the sides 16 and 18, respectively, at end 36 of playing surface 12 where the sides 16 and 18 are extended to form the upper portion sides 17 and 19. As can be seen in FIGS. 3 and 6, the forward surface of the back-stop member 34 interfaces with end 36 of the playing surface 12 and extends downwardly into the catcher box or pit 38 to the covering means 44.

The back-stop member 34 is utilized in games described hereinafter where it is desired to retain playing pieces on the playing surface 12; the back-stop member 34 is removed for games in which it is desired to let the playing pieces or knocked down or moved pieces, such as tapered pins 60, move or drop into the cather box or pit 38. The back-stop member 34 is shown pictorily in FIG. 1, inserted in slots 35 and 37 in FIGS. 2, 3, and 6, and removed in FIGS. 9 and 12.

The peg-like members 48 are removably affixed to the playing surface 12 by removably inserting each of them in a hole 32 in the playing surface 12. There are two rows of a plurality of holes 32, one row of three and one row of two. The row of three holes 32 is on the same transverse line through the common center for the two concentric circles 26 and 24, and the center hole 32 of the three holes 32 is at and centered on the common center for the two concentric circles 26 and 24. The two exterially placed holes 32 in this row of three holes 32 are spaced from the center hole 32 and along the aforementioned transverse line phantomly drawn through the common center of the two concentric circles 26 and 24.

The row of two holes 32 is on a transverse phantom line through, or adjacent to, the fourth row of spots 28. In FIG. 2 the two holes 32 are shown adjacent to the two interiorly located spots 28 for purposes of clarity. It is to be understood however that the centers of these two holes 32 could coincide with the centers of the two interiorly located spots 28 in the fourth row of spots 28.

The plurality of peg-like members 48 are removably inserted, one peg-like member 48 for each hole 32, into the playing surface 12 in accordance with the need for peg-like members 48 for a game being played.

It is to be understood that although specific locations of markings and holes have been noted for this invention, it is within the scope and intent of this invention that other markings or holes could be added or the existing markings or holes otherwise modified without departing from the invention itself.

Turning now to a description of four games which are incorporated into the present invention, and to a description of the playing pieces for those four games, it is to be noted that the user may vary the set-ups for the four games and create other games with ground rules for each to exact special skills from the user. Such possible variations demonstrate the wide flexibility and universal application of the device 10.

Figure 5:
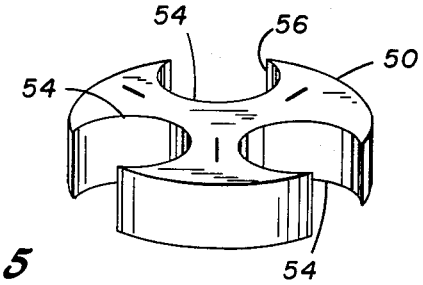
FIG. 5 is a perspective view of a first playing piece for a first game.

The layout for the first incorporated game is illustrated in FIG. 2 with the first playing piece 50 shown in FIG. 5. The layout for the first game, which the inventor calls "Slot-Shot", utilizes the back-stop member 34 removably inserted and affixed in slots 35 and 37, and five peg-like members 48 each removably inserted in one of five holes 32.

The first playing pieces for the first incorporated game are slotted rings or disks 50. The slotted disks 50 are circular in general configuration and of sufficient thickness to provide a reasonable weight for a player to have some control to push or shove the slotted disk 50 down the playing surface 12 from the starting end 13. It is to be noted that in this and the other incorporated games that the playing pieces may be pushed or shoved directly down the longitudinal length of the playing surface 12, or the playing pieces may be bounced or richocheted off of the side boards 16 and 18 as skills increase for control in making the largest score possible.

Scoring for the first game may use the amounts for the playing surface areas as hereinbefore mentioned, plus a bonus of double or triple of the score amount when the slotted disk 50 comes to rest with one of the slots completely or partially around one of the peg-like members 48. Ground rules for such situations may be established as the skill of this game is to have one of the plurality of slots of slotted disk 50 surround or encircle one of the peg-like members 48.

A variation of the first incorporated game is to remove the back-stop member 34 so that the skill must incorporate thrust control in order to prevent the slotted disk from dropping into the catch box or pit 38.

The slotted disk 50, which is circular-like in general configuration, has a plurality of curved recesses or slots 54 cut into the periphery of the slotted disk 50. The curved recesses or slots 54 are each more or less generally circular, three are shown for illustration, with a portion of the generally circular configuration of the curved slot 54 intersecting the periphery of the generally circular configuration of the slotted disk 50, thereby forming a mouth 56 in the peripheral surface of the slotted disk 50 that leads to the interior of each of the curved slots 54. It is through this mouth 56 that the slotted disk 50 is able to pass around a peg-like member 48 for a higher score.

The plurality of slotted disks 50 playing pieces are provided in sets of two each so that a number of persons may play at one time, with the winner being the one with the highest score or the one first reaching a ground rule specified score. Players in turn may attempt to dislodge an opponent's slotted disk 50 from a favored scoring position The sets of slotted disks 50 are separately and differently colored and/or numbered in order to easily identify them when they have been played. The numeral 1 is shown on the slotted disk 50 in FIG. 5; the colors for a set may be red, green, blue, yellow or any other appropriate color in order to easily identify a set.

Figure 8:
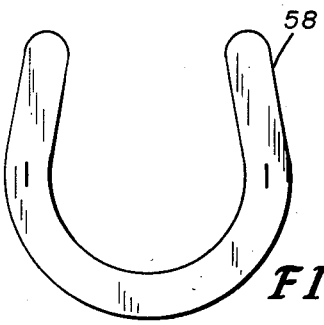
FIG. 8 is a plan view of a second playing piece for a second game.

A second incorporated game, which the inventor calls "Shu-Peg", is laid out as illustrated in FIG. 6. The playing piece is illustrated in FIG. 8.

The layout for the second game incoporates the back-stop member 34, removably inserted and affixed as aforementioned, and one peg-like member 48 removable inserted and affixed as hereinbefore mentioned. The one peg-like member 48 is shown in the hole 32 located at the common center for the concentric circles 26 and 24. A variation of this game could be the removal of the back-stop member 34 and the relocation of the peglike member 48 to another hole 32 or the use of a plurality of peg-like members 48.

Using the first description of the layout, the playing piece 58 is more or less horse-shoe shaped. The object being similar to a game of horse-shoes to score a so-called "ringer" around the peg-like member 48, with other playing pieces 58 scoring in relation to the peg-like member and the location of the nearest opponent's playing pieces 58 to the peg-like member 48. Scoring may also be based, as an alternative, on the horse-shoe-like playing pieces 58 that lie within the concentric circles 26 and/or 24, and no score for playing pieces 58 in the area outside the outer circle 24. Ground rules may establish the procedure that will be utilized for a game.

Again, the horse-shoe-like playing pieces 58 may be separately and differently colored in pairs of two each and/or sequentially numbered as pairs for easy identification. A plurality of such sets of playing pieces 58 is provided for several players. The numbering of the playing pieces 58 is shown in FIG. 8 with the numeral 1.

Figure 9:
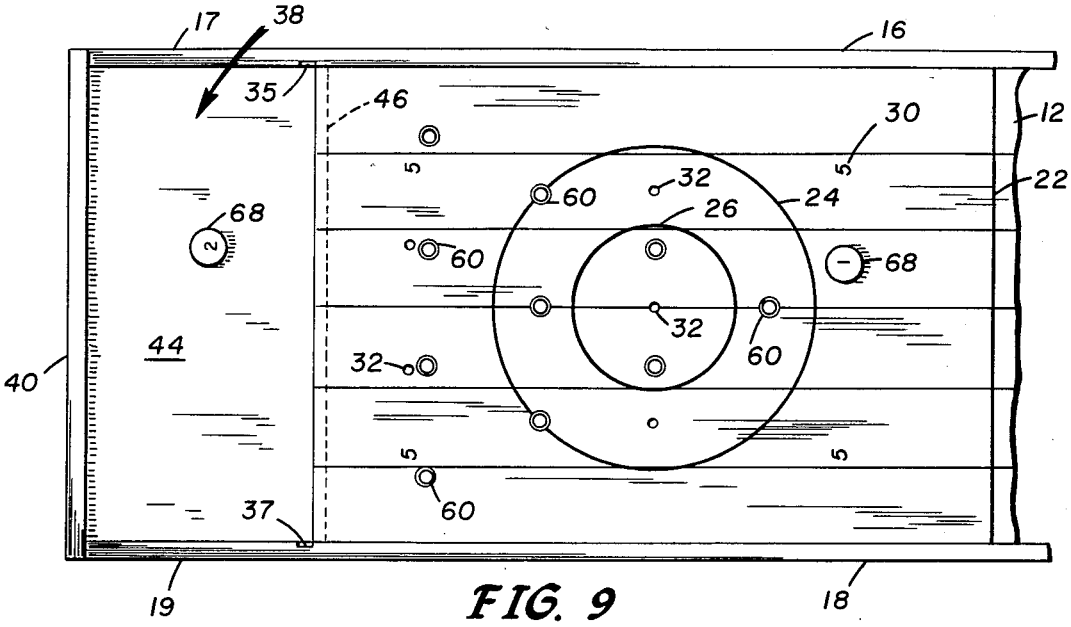
FIG. 9 is a partial plan view of FIG. 1 showing components and playing pieces added for a third game.
Figure 10:
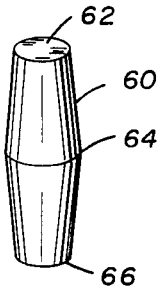
FIG. 10 is a perspective view of a second component used for a third game.

The layout for the third game incorporated in the device 10 which the inventor calls "Rho-Bowl", in FIG. 9. This game does not utilize the back-stop member 34. Ten tapered pins 60 are located on the ten spots 28 on the playing surface 12. A circular playing piece disk 68 of suitable thickness to provide sufficient weight for control. The playing piece disk 68 is solid and may, if desired, be weighted with suitable materials placed within the interior of the playing piece disk 68.

Figure 11:
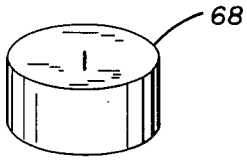
FIG. 11 is a perspective view of a third playing piece for a third or fourth game.

The playing piece disks 68 may be separately and differently colored and/or numbered as hereinbefore mentioned for other playing pieces. The playing piece disks 68 are provided in sets of three. The numbering is illustrated in FIG. 11 with the numeral 1 and in FIG. 9 with the numeral 1 on a playing piece disk 68 on the playing surface 12 and with the numeral 2 on a playing piece disk 68, of another set, in the catcher or pit 38.

The third game is played and scored similar to bowling, by using up to three of the playing piece disks 68 to knock down as many of the tapered pins 60. A variation to the game, in order to improve skills, is to use only a portion of the ten tapered pins 60 and spot them on selected spots 28.

The tapered pin 60 has a center diameter 64 and tapers toward each end to a top diameter 62 and a bottom diameter 66. It is to be understood that it is within the scope and intent of this invention to vary the configuration of the tapered pin 60 to other configurations.

Figure 12:
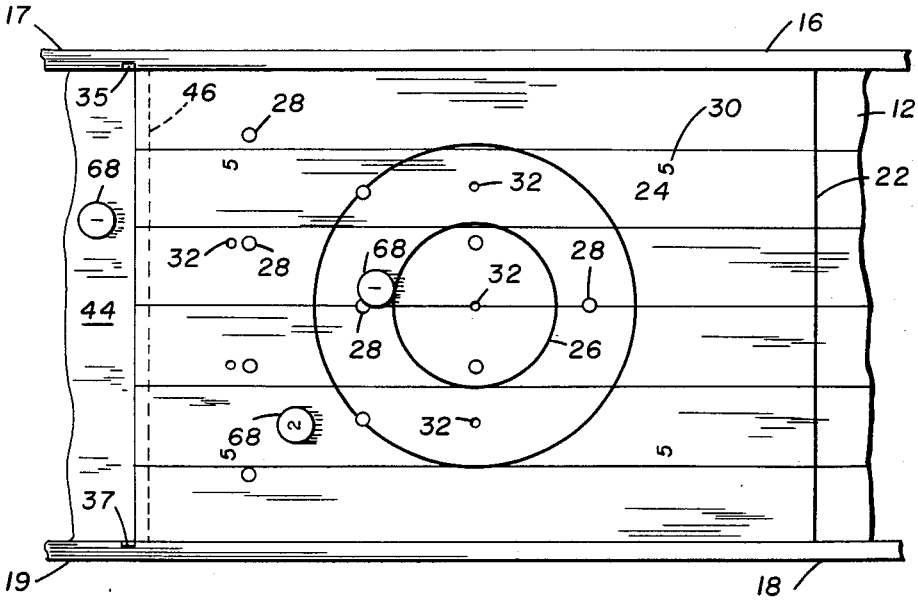
FIG. 12 is a partial plan view of FIG. 1 showing playing pieces added for a fourth game.

The fourth game incorporated in the device 10 is shown in the layout in FIG. 12. The inventor calls this game "K-Shot". This game does not use the back-stop member 34 or any of the peg-like pins 48 or the tapered pins 60. The playing piece disks 68 are used in the aforementioned sets.

The fourth game is based on the skill of being able to place playing piece disks 68 within the highest scoring areas, described hereinbefore, on the playing surface 12. In turn, an opponent or team with other sets of the playing piece disks 68 attempt to also place playing piece disks 68 within the same high-scoring areas and, at the same time, dislodge the other player's (or team's) playing piece disks 68 that are already in high scoring positions. Ground rules can establish the limits of a game.

A variation of the game is to removably insert the back-stop 34 and use it to bounce or richochet the playing piece disks 68 by skill to a better scoring position.

Thus, it can be seen that the device 10 has a flexible and universal use for a plurality of games and a variety of applications of these games.

It should further be noted that the playing surface 12 may be a single member, a plurality of members held together by suitable batten strips (not shown), or laminated and suitably affixed into a one piece member. Further, longitudinal lines may be marked upon the longitudinal surface of the playing surface 12 to improve the skill of pushing or shoving the various playing pieces in a straight line. Such additions are within the scope and intent of the invention.

As can be readily understood from the foregoing description to the invention, the present structure can be configured in different modes to provide a device for playing a plurality of games.

Accordingly, modifications and variations to which the invention is susceptible may be practiced without departing from the scope and intent of the appended claims.

What is claimed is:

1. A game structure for a plurality of games, comprising:

a playing surface, said playing surface having first and second ends, first and second sides, and a thickness;

an adjustable removable support means, said support means being suitably removably affixed to an underside surface of said playing surface, said support means adjustably elevating said playing surface to a suitable height for playing games thereon;

a catch pit, said catch pit being suitably assembled and affixed to said first end of said playing surface;

at least two side members, said side members being suitably affixed to said playing surface without spacing between said side members and said playing surface, one of said side members being affixed to said first side and one of said side members being affixed to said second side of said playing surface, said side members extending along only a portion of said sides of said playing surface, said side members being spaced from said second end of said playing surface;

a plurality of markings, said plurality of markings being permanently and suitably affixed to the uppermost surface of said playing surface, said plurality of markings consisting of at least two transverse lines across and spaced apart upon said playing surface, at least two concentric circles spaced apart, a plurality of small spaced apart circular spots, and a plurality of spaced apart numerals representing score amounts, a first line of said at least two transverse lines across said playing surface being spaced from said first end of said playing surface, and a second line of said at least two transverse lines across said playing surface being spaced from said second end of said playing surface which is opposite to said first end, said second line of said at least two transverse lines across said playing surface being in close proximity to ends of said side members spaced from said second end of said playing surface, said at least two concentric spaced apart circles being centrally located on and within that portion of said playing surface between said first end of said playing surface and said first of said at least two transverse lines, said plurality of small spaced apart circular spots are set in a triangular configuration, said triangular configuration having one single spot in a first row at the apex of said triangular configuration, two spaced spots in a second row spaced from said first row, three spaced spots in a third row spaced from said second row, and four spaced spots in a fourth row spaced from said third row, said fourth row being the base of said triangular configuration, said triangular configuration of said plurality of spots being centrally located between said at least two side members, said apex of said triangular configuration being spaced a greater distance from said first line of said at least two transverse lines than said fourth row of said spots is spaced from said first end of said playing surface, plurality of numerals representing score amounts are symmetrically located on and within the area of the playing surface between said first end of said playing surface and said first transverse line, said plurality of numerals being outside the outermost circle of said two concentric circles;

a plurality of game components, a first portion of said plurality of game components being removably affixed to said playing surface, a second portion of said plurality of game components being removably placed upon the surface of said playing surface, and a third portion of said game components being removably affixed to said side members, said game components being affixed and placed in a variety of combinations for a plurality of games, but at no time are all said game components affixed to or placed upon said playing surface for a specific game;

a plurality of playing pieces, said plurality of playing pieces further consisting of a plurality of a first playing piece, a plurality of a second playing piece, and a plurality of a third playing piece, each said first, second, and third playing piece being used for different games of said plurality of games, but at no one time is there more than one separate plurality of playing pieces used upon said playing surface for a specific game.

2. A game structure as recited in claim 1, wherein said first portion of said plurality of said game components consists of rod-like members that are round and dowel-like and peg-like, and additionally, a plurality of apertures, each said apertures being sized so as to receive and permit the removable insertion and affixing in position of one of said first game components in each said aperture, said plurality of apertures being set into uppermost surface of said playing surface, but not penetrating through the structure of said playing surface, said plurality of apertures being set in at least two rows spaced apart, at least three apertures being in the first of said at least two rows, the center aperture of said at least three apertures in said first row being centered and located at the common center of said two concentric circles, said second row being spaced from said first end of said playing surface and having at least two apertures in said second row, said at least two apertures being spaced apart and each equally spaced from said side members, said plurality of said first portion of said game components being removably inserted and removably affixed in said plurality of said apertures thereby being arranged for playing a first game.

3. A game structure as recited in claim 2, wherein all of said first portion of said game components are removed from said plurality of apertures except one of said first game components that is left removably inserted in said aperture that is centered and located at said common center of said at least two concentric circles, said one first game component removably inserted in said aperture thereby being arranged for playing a second game.

4. A game structure as recited in claim 3, wherein said plurality of said first playing pieces are disk-like in configuration, each said disk-like playing piece having a plurality of circular-like curved slots therein, said circular-like curved slots being so located so that the periphery of each said curved slot intersects the general periphery of said disk-like playing piece so as to provide an opening in the peripheral side surface of said disk-like playing piece, which said opening communicates with the interior of the respective said circular-like curved slot, said plurality of first playing pieces being suitably colored and numbered in sets, said plurality of first playing pieces thereby being for playing said first game.

5. A game structure as recited in claim 3, wherein said plurality of said second playing pieces are horseshoe shaped in configuration, said horseshoe shaped playing pieces being suitably colored and numbered in sets, said plurality of second playing pieces being for playing said second game.

6. A game structure as recited in claim 1, wherein said second portion of said plurality of game components consists of a plurality of double truncated cone-like pin-like members, said pin-like members being wider at the center than at the ends thereof, the sides of said pin-like members tapering from said wide center toward the small ends thereof, at least one end being a flat surface whereby said pin-like members may be set upon a surface without falling over, said plurality of pin-like members being set upon said plurality of small circular spots, one pin-like member to each said small circular spot, said setting of said pin-like members on said spots thereby being arranged for playing a third game.

7. A game structure as recited in claim 6, wherein said plurality of third playing pieces are disk-like in configuration, each said disk-like playing piece being solid, said disk-like playing pieces being suitably colored and numbered in sets, said plurality of third playing pieces thereby being for playing said third game.

8. A game structure as recited in claim 1, wherein said third portion of said game components consists of a single board-like member, and additionally a pair of slot means, said slot means being cut into the interior surface of said at least two side members, one said slot means in each of said side member, said single board-like member having two ends, said single board-like member being removably affixed to said side members by removably inserting one end of said single-board member into one of said slot-like means and the other end of said single board-like member being removably inserted into the other of said slot-like means, said use of said single board-like member thereby being arranged for playing a first and a second game.

9. A game structure as recited in claim 1, wherein all of said game components are removed from said playing surface and said side members, said removal of all of said game components thereby being arranged for playing a fourth game.

10. A game structure as recited in claim 9, wherein said plurality of third playing pieces are disk-like in configuration, each said disk-like playing piece being solid, said disk-like playing pieces being suitably colored and numbered in sets, said plurality of third playing pieces thereby being for playing said fourth game.

* * * * *